US010484787B2

(12) United States Patent
Yamada

(10) Patent No.: US 10,484,787 B2
(45) Date of Patent: Nov. 19, 2019

(54) LOUDSPEAKER APPARATUS

(71) Applicant: ZORZO CO., LTD., Tokyo (JP)

(72) Inventor: Teppei Yamada, Tokyo (JP)

(73) Assignee: ZORZO CO., LTD., Tokyo (JP)

( * ) Notice: Subject to any disclaimer, the term of this patent is extended or adjusted under 35 U.S.C. 154(b) by 0 days.

(21) Appl. No.: 15/943,841

(22) Filed: Apr. 3, 2018

(65) Prior Publication Data

US 2018/0288522 A1 Oct. 4, 2018

(30) Foreign Application Priority Data

Apr. 4, 2017 (JP) ..... 2017-074359

(51) Int. Cl.
*H04R 1/28* (2006.01)
*H04R 1/22* (2006.01)

(52) U.S. Cl.
CPC ..... *H04R 1/2819* (2013.01); *H04R 1/227* (2013.01); *H04R 1/2803* (2013.01); *H04R 1/2834* (2013.01); *H04R 1/2888* (2013.01); *H04R 2400/11* (2013.01)

(58) Field of Classification Search
CPC .... H04R 1/2819; H04R 1/227; H04R 1/2803; H04R 1/2834; H04R 1/2888; H04R 2400/11
See application file for complete search history.

(56) References Cited

U.S. PATENT DOCUMENTS 3,202,773 A * 8/1965 Tichy ..... H04R 1/2857 181/147
4,039,044 A * 8/1977 Heil ..... H04R 1/02 181/144
4,783,820 A * 11/1988 Lyngdorf ..... H04R 1/227 181/145

(Continued)

FOREIGN PATENT DOCUMENTS

| | | |
|---|---|---|
| JP | 5719718 | 5/2015 |
| JP | 5719958 | 5/2015 |
| WO | 2009/039852 | 4/2009 |

OTHER PUBLICATIONS

Extended European search report dated Aug. 9, 2018 in European Application No. 18162306.7.

*Primary Examiner* — Joshua Kaufman
(74) *Attorney, Agent, or Firm* — Wenderoth, Lind & Ponack, L.L.P.

(57) ABSTRACT

A loudspeaker apparatus includes at least three speaker units, and a space defining part defining at least two sealed spaces. Each of the speaker units has a diaphragm having two surfaces, and a driver unit for inputting an electrical signal and driving the diaphragm. Each of the sealed spaces has at least two boundary diaphragms. Each of the boundary diaphragms is one of the diaphragms, disposed so that a first one of the surfaces faces inside the sealed space and a second one of the surfaces faces outside the sealed space. When at least one of the boundary diaphragms is driven outward from the sealed space, at least one of the other (Continued)

boundary diaphragms is driven inward to the sealed space. The boundary diaphragms driven outward and the boundary diaphragms driven inward are the same in number, and thereby a volume of the sealed space is kept constant.

11 Claims, 4 Drawing Sheets

(56) References Cited

U.S. PATENT DOCUMENTS 5,073,945 A * 12/1991 Kageyama ..... H04R 1/227
381/184
5,374,124 A * 12/1994 Edwards ..... H04R 3/12
181/145
5,594,804 A * 1/1997 Kim ..... H04R 1/403
381/182
5,850,460 A * 12/1998 Tanaka ..... H04R 1/2834
381/186
6,031,919 A * 2/2000 Funahashi ..... H04R 1/2842
181/145
6,363,157 B1 * 3/2002 Chick ..... H04R 1/26
381/89
6,985,593 B2 * 1/2006 Nichols ..... B60R 11/0217
181/145
7,277,552 B2 * 10/2007 Graber ..... H04R 1/227
181/199
7,551,749 B2 * 6/2009 Rosen ..... B60R 11/0217
381/186
9,407,979 B2 * 8/2016 Yamada ..... H04R 1/02
9,525,932 B2 * 12/2016 Litovsky ..... H04R 1/2834
9,538,269 B2 * 1/2017 Nagaoka ..... H04R 1/288
9,609,405 B2 * 3/2017 Fincham ..... H04R 1/02
10,110,991 B2 * 10/2018 Crosby ..... H04R 1/2819
2012/0177218 A1 * 7/2012 Yamada ..... H04R 3/02
381/89
2018/0014115 A1 * 1/2018 Crosby ..... H04R 1/2819
2018/0288522 A1 * 10/2018 Yamada ..... H04R 1/227

* cited by examiner

*Fig. 11*
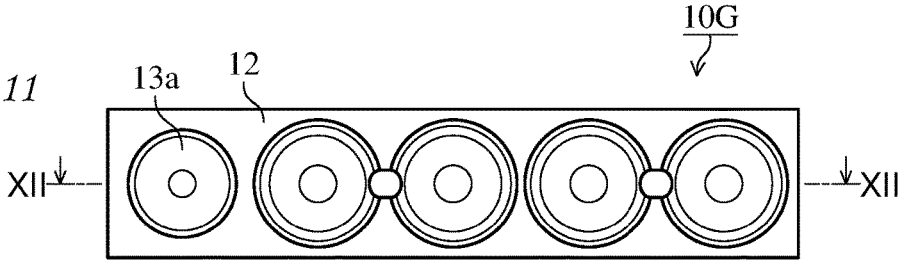
*Fig. 12*
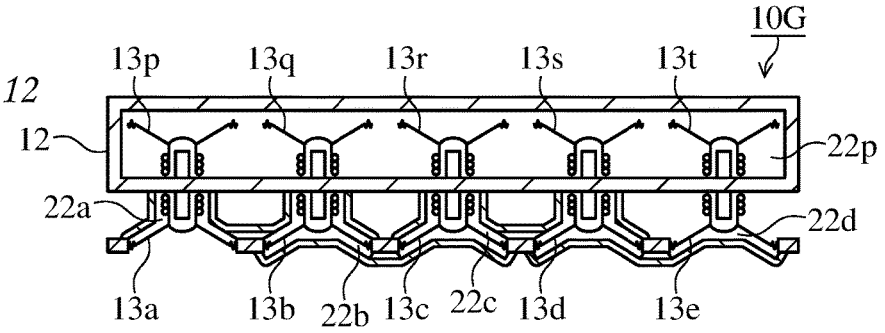
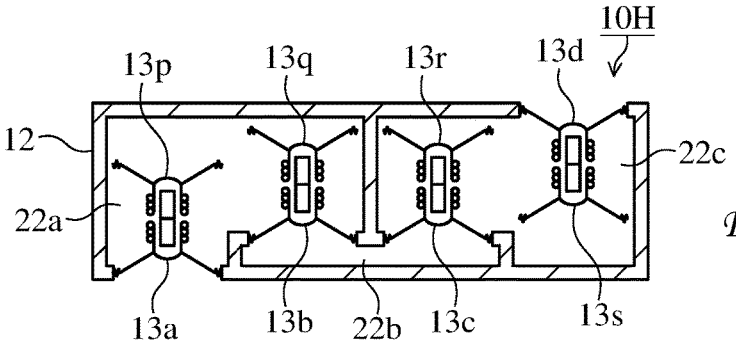
*Fig. 13*
*Fig. 14*
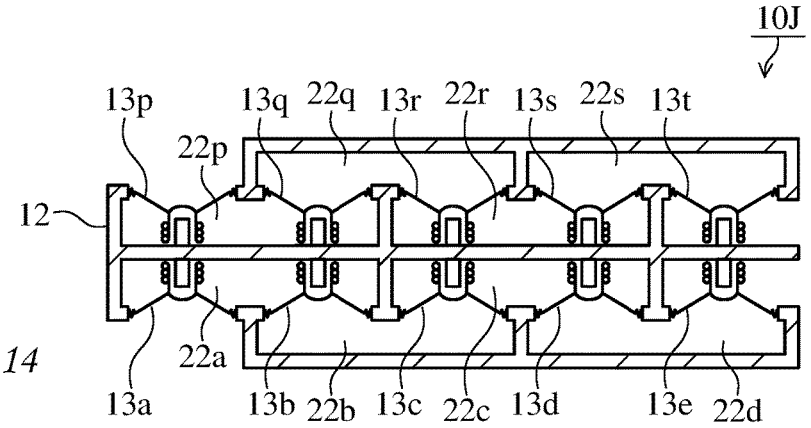

Fig. 15
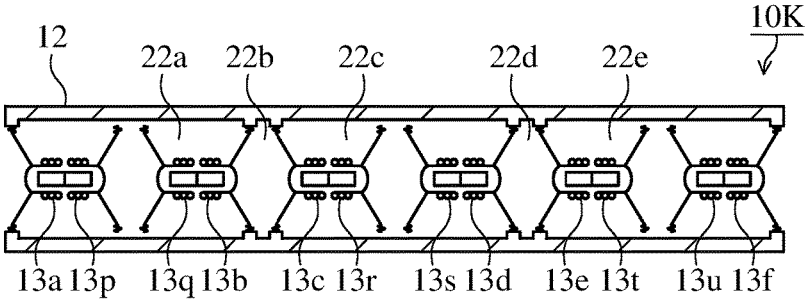
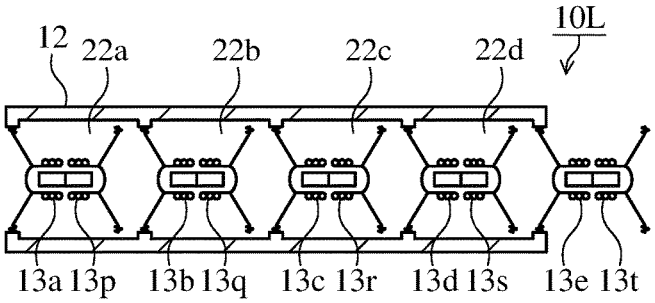
Fig. 16
Fig. 17
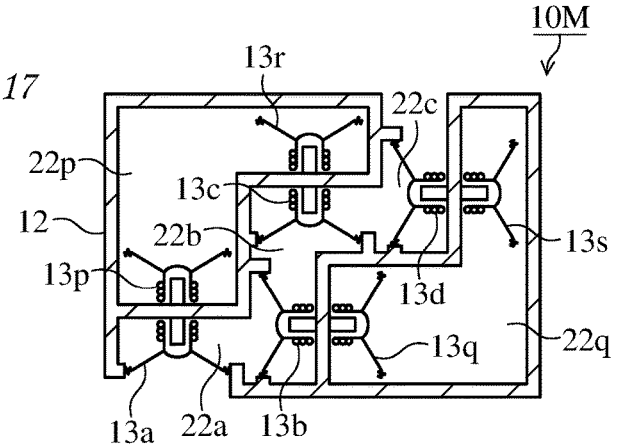
Fig. 18
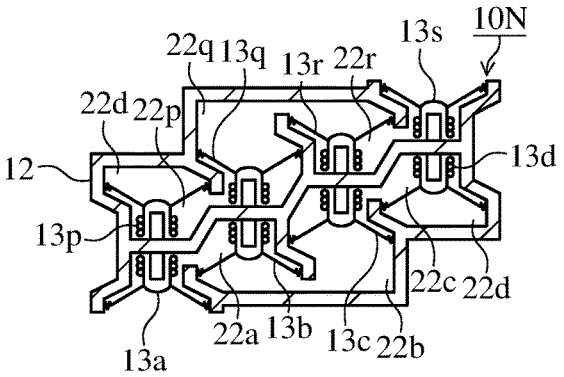
Fig. 19
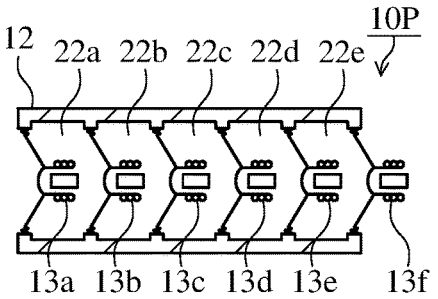

LOUDSPEAKER APPARATUS

TECHNICAL FIELD

The present invention is related to a loudspeaker apparatus.

BACKGROUND ART

Japanese Patent Nos. 5719718 and 5719958 disclose loudspeaker apparatuses having improved characteristics for bass sound by combining a plurality of speaker units.

SUMMARY OF INVENTION

Technical Problem

The present invention aims further improvement of characteristics of loudspeaker apparatus for bass sound.

Solution to Problem

A loudspeaker apparatus may comprise at least three speaker units, and a space defining part defining at least two sealed spaces. Each of the speaker units may have a diaphragm having two surfaces, and a driver unit for inputting an electrical signal and driving the diaphragm. All of the driver unit may input substantially the same electrical signal with substantially the same or opposite phases. Each of at least two of the sealed spaces may have at least two boundary diaphragms. Each of the boundary diaphragms may be one of the diaphragms, disposed so that a first one of the surfaces faces inside the sealed space and a second one of the surfaces faces outside the sealed space. When at least one of the boundary diaphragms is driven outward from the sealed space, at least one of the other boundary diaphragms may be driven inward to the sealed space, the boundary diaphragms driven outward and the boundary diaphragms driven inward may be the same in number, and thereby a volume of the sealed space may be kept constant.

In each of at least one of the sealed spaces, at least two of the boundary diaphragms may be arranged so that the surfaces facing outside the sealed space are oriented to substantially the same directions.

In each of at least one of the sealed spaces, at least two of the boundary diaphragms may be arranged on substantially the same planes.

At least two of the speaker units may be exposed speaker units. In each of the exposed speaker units, at least one of the surfaces of the diaphragm may be exposed outside. Two of the exposed speaker units may be disposed the farthest from one another. Two of the exposed speaker units may be disposed so that the exposed surfaces of the diaphragms are oriented to substantially opposite directions.

At least one of the speaker units may be a sealed speaker unit. In the sealed speaker unit, the two surfaces of the diaphragm may face inside the same or different sealed spaces.

All of the diaphragms may be arranged on substantially the same lines.

The number of the speaker units may be an odd number.

The number of the speaker units may be a product of two natural numbers larger than 1.

At least two of the speaker units may form at least one pair. Each of the pair may include two of the speaker units. In each of the pair, the driver units may be disposed back to back, and input the electrical signals with substantially the same phases, and thereby reaction forces created by movement of the two diaphragms may be cancelled.

Advantageous Effects of the Invention

The volume of the sealed space kept constant enables to cancel back pressures of the diaphragms. This reduces minimal resonance frequency, and thereby improve characteristics for bass sound.

BRIEF DESCRIPTION OF DRAWINGS

FIG. 11 is a front view illustrating another examplary loudspeaker apparatus 10G;

FIG. 12 is an end view taken along XII-XII in FIG. 11;

FIG. 13 is an end view illustrating another examplary loudspeaker apparatus 10H;

FIG. 14 is an end view illustrating another examplary loudspeaker apparatus 10J;

FIG. 15 is an end view illustrating another examplary loudspeaker apparatus 10K;

FIG. 16 is an end view illustrating another examplary loudspeaker apparatus 10L;

FIG. 17 is an end view illustrating another examplary loudspeaker apparatus 10M;

FIG. 18 is an end view illustrating another examplary loudspeaker apparatus 10N; and FIG. 19 is an end view illustrating another examplary loudspeaker apparatus 10P.

DESCRIPTION OF EMBODIMENT

Figure 1:
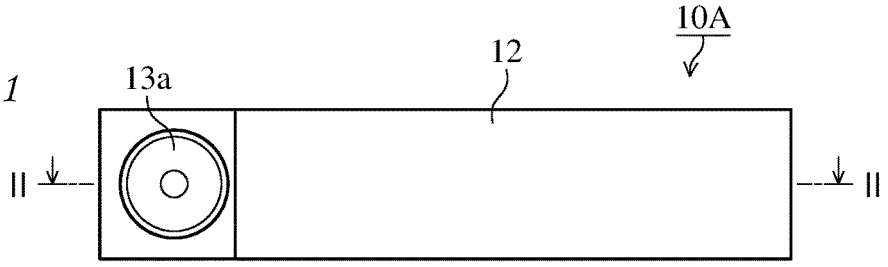
FIG. 1 is a front view illustrating an examplary loudspeaker apparatus 10A.

A loudspeaker apparatus comprises at least three speaker units. For example, the loudspeaker apparatus 10A has five speaker units 13*a* to 13*e*. The loudspeaker apparatus 10B also includes five speaker units 13*a* to 13*e*. Each of the loudspeaker apparatuses 10C and 10D is provided with nine speaker units. Each of the loudspeaker apparatuses 10E and 10K has twelve speaker units 13*a* to 13*u*. Each of the loudspeaker apparatuses 10F, 10G, 10J and 10L includes ten speaker units 13*a* to 13*t*. Each of the loudspeaker apparatuses 10H, 10M and 10N is provided with eight speaker units 13*a* to 13*s*. The loudspeaker apparatuses 10P has six speaker units 13*a* to 13*f*.

Each of the speaker units has a diaphragm and a driver unit. For example, the speaker unit 13*a* is provided with a diaphragm 31*a* and a driver unit 32*a*. The diaphragm has two surfaces, and vibrates air to generate sound. The driver unit inputs an electrical signal, and drives the diaphragm back and forth by the input electrical signal.

Preferably, all of the speaker units are the same. Preferably, all of the driver units are wired to input the same electrical signals. At least one of the driver units may be wired in a reversed polarity. That is, all of the driver units inputs substantially the same electrical signals with substantially the same or opposite phases. For example, in the loudspeaker apparatus 10C, three parallel circuits, each formed by parallelly connecting three of the speaker units, are connected in series. In this manner, plurality of parallel circuits may be formed by parallelly connecting the same number of the speaker units, and may be connected in series. This can easily achieve the same inputs for all of the driver units. In the loudspeaker apparatus 10D, three series circuits, each formed by connecting three of the speaker units in series, are parallelly connected. In this manner, plurality of series circuits may be formed by connecting the same number of the speaker units in series, and may be parallelly connected. This can also easily achieve the same inputs for all of the driver units. Thus, the number of the speaker units is preferable to be a product of two integers, or natural numbers, larger than 1. Further preferably, the two integers are the same or roughly the same. This makes the input impedance of a series-parallel circuit or parallel-series circuit of the speaker units equal, or roughly equal, to that of the single speaker unit, and thereby enables easy impedance matching.

The loudspeaker apparatus comprises a space defining part. For example, the loudspeaker apparatus 10A has a body 12 as the space defining part. The body 12 has a shape formed by connecting four boxes 21*a* to 21*d*. The body 12 has five circular holes. The inside of the box 21*a* communicates the outside of the loudspeaker apparatus 10A via a first one of the holes, and communicates the inside of the box 21*b* through a second one of the holes. A third one of the holes connects the inside of the boxes 21*b* and 21*c*. The inside of the box 21*d* is linked with the inside of the box 21*c* via a fourth one of the holes, and linked with the outside of the loudspeaker apparatus 10A throughout a fifth one of the holes.

The loudspeaker apparatus 10B is also provided with a body 12 as the space defining part. Different from the loudspeaker apparatus 10A, the body 12 of the loudspeaker apparatus 10B has a board 23, four front covers 24*b* to 24*e*, four rear covers 25*a* to 25*d*, and four pipes 26*a* to 26*d*. The board 23 has a roughly rectangular shape with five circular holes. The front covers 24*b* to 24*e* are fixed to the board 23 at a front side to cover four of the holes. The leftmost hole is not covered with the front covers. The rear covers 25*a* to 25*d* are fixed to the board 23 at a rear side to cover four of the holes. The rightmost hole is not covered with the rear covers. The pipe 26*a* is fixed on the rear side of the board 23, and connects spaces covered with the rear covers 25*a* and 25*b*. The pipe 26*b* is located on the front side of the board 23, and links spaces surrounded by the front covers 24*b* and 24*c*. The pipe 26*c* is disposed on the rear side surface of the board 23, and communicates spaces inside the rear covers 25*c* and 25*d*. The pipe 26*d* is mounted on the front side surface of the board 23, and joins spaces enclosed with the front covers 24*d* and 24*e*.

The loudspeaker apparatus 10E also includes a body 12 as the space defining parts. The body 12 of the loudspeaker apparatus 10E has a box shape formed by combining roughly rectangular boards.

The loudspeaker apparatus 10E also comprises a body 12 as the space defining parts. The body 12 of the loudspeaker apparatus 10E is comprise of a front half part and a rear half part. The front half part has a shape similar to the body 12 of the loudspeaker apparatus 10A. The rear half part is provided with five sealed small rooms.

The loudspeaker apparatus 10G also has a body 12 as the space defining parts. The body 12 of the loudspeaker apparatus 10F includes a front half part and a rear half part. The front half part has a shape similar to the body 12 of the loudspeaker apparatus 10B. The rear half part is a sealed and roughly rectangular parallelpiped box.

The loudspeaker apparatus 10J also includes a body 12 as the space defining parts. The body 12 of the loudspeaker apparatus 10J has a front half part and a rear half part. Both of the front and rear half parts have a shape similar to the body 12 of the loudspeaker apparatus 10A.

Each of the loudspeaker apparatuses 10K, 10L and 10P comprises a body 12 as the space defining part. Each of the bodies 12 of the loudspeaker apparatuses 10K, 10L and 10P has a roughly cylindrical shape.

Each of the loudspeaker apparatuses 10H and 10M is also provided with a body 12 as the space defining parts. Each of the bodies 12 of the loudspeaker apparatuses 10H and 10M has a hollow rectangular parallelpiped shape with partitions inside.

The loudspeaker apparatus 10N also has a body 12 as the space defining parts. The body 12 of the loudspeaker apparatus 10N has a hollow complicated shape with partitions inside.

The space defining part defines at least two sealed spaces. For example, the body 12 of the loudspeaker apparatus 10A defines four sealed spaces 22*a* to 22*d* in cooperation with the diaphragms 31*a* to 31*e* of the speaker units 13*a* to 13*e*. The diaphragm 31*a* of the speaker unit 13*a* is fixed to close the hole between the space 22*a* inside the box 21*a* and the outside. The diaphragm 31*b* of the speaker unit 13*b* is mounted to shut the hole between the spaces 22*a* and 22*b* inside the boxes 21*a* and 21*b*. This achieves the space 22*a* inside the box 21*a* to be sealed. The other three of the holes are also blocked with the diaphragms 31*c*, 31*d* and 31*e*. Thus, the spaces 22*b* to 22*d* inside the boxes 21*b* to 21*d* are also sealed.

The body 12 of the loudspeaker apparatus 10B defines four sealed spaces 22*a* to 22*d* in cooperation with the speaker units 13*a* to 13*e*. The diaphragm 31*a* to 31*e* is fixed to close all of the holes provided through the board 23. The space 22*a* is surrounded and sealed by the board 23, the rear covers 25*a* and 25*b*, the pipe 26*a*, and the diaphragms 31*a* and 31*b*. The space 22*b* is enclosed and sealed by the board 23, the front cover 24*b* and 24*c*, the pipe 26*b*, and the diaphragms 31*b* and 31*c*. The space 22*c* is covered and sealed by the board 23, the rear covers 25*c* and 25*d*, the pipe 26*c*, and the diaphragms 31*c* and 31*d*. The space 22*d* is closed and sealed by the board 23, the front cover 24*d* and 24*e*, the pipe 26*d*, and the diaphragms 31*d* and 31*e*.

The body 12 of the loudspeaker apparatus 10E defines five sealed spaces 22*a* to 22*e*. The body 12 of the loudspeaker apparatus 10H defines three sealed spaces 22*a* to 22*c*. The body 12 of the loudspeaker apparatus 10J defines eight sealed spaces 22*a* to 22*s*. The body 12 of the loudspeaker apparatus 10K defines five sealed spaces 22*a* to 22*e*. The body 12 of the loudspeaker apparatus 10L defines four sealed spaces 22*a* to 22*d*. The body 12 of the loudspeaker apparatus 10P defines five sealed spaces 22*a* to 22*e*.

The body 12 of the loudspeaker apparatus 10N defines seven sealed spaces 22*a* to 22*r*. Although the sealed space 22*d* is illustrated as separated to left and right spaces, the two spaces are communicated behind, not shown, to form one sealed space.

The body 12 of the loudspeaker apparatus 10F defines nine sealed spaces 22*a* to 22*t*. Four of the sealed spaces 22*a* to 22*d* are defined in cooperation with the diaphragms 31*a* to 31*e*, while the other five of the sealed spaces 22*p* to 22*t* are defined only by the body 12.

The body 12 of the loudspeaker apparatus 10G defines five sealed spaces 22*a* to 22*p*. Four of the sealed spaces 22*a* to 22*d* are defined in cooperation with the diaphragms 31*a* to 31*e*, while the other one of the sealed spaces 22*p* is defined only by the body 12.

The body 12 of the loudspeaker apparatus 10M defines five sealed spaces 22*a* to 22*q*. Three of the sealed spaces 22*a* to 22*c* are defined in cooperation with the diaphragms, while the other two of the sealed spaces 22*p* and 22*q* are defined only by the body 12.

In this manner, at least two of the diaphragms cooperates with the space defining part to define the sealed spaces. These diaphragms are called hereinafter as "boundary diaphragms". In other words, the boundary diaphragm is disposed so that a first one of the surfaces faces inside the sealed space and a second one of the surfaces faces outside the sealed space. For example, the diaphragm 31*a* in the loudspeaker apparatus 10A is a boundary diaphragm. It should be noted that the second surface may face inside the other sealed space than the first surface faces. Thus, all of the diaphragms 31*a* to 31*e* in the loudspeaker apparatus 10A are boundary diaphragms. However, the diaphragms 31*p* to 31*u* in the loudspeaker apparatus 10E are not boundary diaphragms, since they are entirely enclosed within one sealed space. Also, the diaphragm of the speaker unit 31*t* in the loudspeaker apparatus 10L is not a boundary diaphragm, since it is entirely exposed outside.

When at least one of the surfaces of the diaphragm faces outside, the diaphragm is called as "exposed". The speaker unit having the "exposed" diaphragm is called as "exposed speaker unit". For example, the speaker unit 13*a* in the loudspeaker apparatus 10A is an exposed speaker unit, and has the boundary diaphragm 31*a*. However, the exposed speaker unit is not limited to have a boundary diaphragm. For example, the speaker unit 13*t* in the loudspeaker apparatus 10L is also an exposed speaker unit, while the diaphragm of the speaker unit 13*t* is not a boundary diaphragm.

When each of the two surface of the diaphragm faces inside one of the sealed spaces, the diaphragm is called as "sealed". The speaker unit having the "sealed" diaphragm is called as "sealed speaker unit". For example, the speaker unit 13*b* in the loudspeaker apparatus 10A is a sealed speaker unit, and has the boundary diaphragm 31*b*. However, the sealed speaker unit is not limited to have a boundary diaphragm. For example, the speaker unit 13*p* in the loudspeaker apparatus 10E is also a sealed speaker unit, while the diaphragm of the speaker unit 13*p* is not a boundary diaphragm.

Each of the sealed spaces has an even number of the boundary diaphragms. For example, in the loudspeaker apparatus 10A, the sealed space 22*a* has the two boundary diaphragms 31*a* and 31*b*, and each of the other sealed spaces 22*b* to 22*d* also has the two boundary diaphragms. The number of the boundary diaphragms may be zero. For example, the sealed spaces 22*p* to 22*t* in the loudspeaker apparatus 10F have no boundary diaphragms. The number of the boundary diaphragms may be four, six or larger, although such examples are not shown.

Half of the boundary diaphragms is driven toward the opposite direction to the other half of the boundary diaphragms. In other words, one of the boundary diaphragms is driven outward from the sealed space, when another of the boundary diaphragms is driven inward to the sealed space. The number of the boundary diaphragms driven inward is constantly equal to that of the boundary diaphragms driven outward. This makes the sealed space kept constant in volume, at all times. The constant volume of the sealed space produces constant air pressure in the sealed space.

The constant air pressures in all of the sealed spaces enable to eliminate air pressure difference between spaces faced by the first and second surfaces of the diaphragm in the sealed speaker unit. This reduces air resistance against driving of the diaphragm. Thus, minimal resonance frequency of the loudspeaker apparatus is reduced, and characteristics for bass sound is improved.

For example, in the loudspeaker apparatuses 10A, 10B and 10F, the speaker units 13*a*, 13*c* and 13*e* input electrical signals with the same phases, while the speaker units 13*b* and 13*d* input electrical signals with the opposite phases. Thereby, the diaphragms 31*a*, 31*c* and 31*e* are driven toward the same directions, and the diaphragms 31*b* and 31*d* are driven toward the opposite directions. This achieves the constantly fixed volume of the sealed spaces 22*a* to 22*d*.

In the loudspeaker apparatus 10H, the electrical signals input to the speaker unit 13*a* and 13*c* have the same phases, while the electrical signals input to the speaker unit 13*b* and 13*d* have the opposite phases. This maintains the unvaried volume of the sealed spaces 22*a* to 22*c*.

In the loudspeaker apparatus 10N, the electrical signals having the same phases are input to the speaker units 13*a*, 13*c*, 13*p* and 13*r*, while the electrical signals having the opposite phases are input to the speaker units 13*b*, 13*d*, 13*q* and 13*s*.

In the loudspeaker apparatus 10P, all of the electrical signal phases input by the speaker units 13*a* to 13*f* are the same.

The following expression holds for the minimal resonance frequency of the loudspeaker apparatus:

$$f_0 = C\sqrt{\frac{K_0}{m_0}}$$

where $f_0$ denotes a minimal resonance frequency, C denotes a constant, $K_0$ denotes a spring constant, and $m_0$ denotes an equivalent mass.

In the case that a single speaker unit has a diaphragm opened at front and rear side, the following expression holds:

$$K_0=K+2K',\ m_0=m$$

where m denotes an equivalent mass of the single speaker unit, K denotes a spring constant in the driver unit, and K' demotes a spring constant created by air resistance at each of the front and rear surface of the diaphragm.

Thus, the following expression is derived:

$$f_1 = C\sqrt{\frac{K+2K'}{m}}$$

where $f_1$ denotes the minimal resonance frequency of the single speaker unit with the diaphragm opened at front and rear sides.

In the case of the loudspeaker apparatus 10A, which has the five speaker units 13*a* to 13*e*, the equivalent mass increases to five times, and the spring constant of the driver unit also increases to five times. In contrast, the air resistances against the diaphragms are eliminated except for the front surface of the diaphragm 31*a* and the rear surface of the diaphragm 31*e*, which are surfaces exposed outside. Thereby, the spring constant by air resistance is not changed. Thus, the following expressions are derived:

$$K_0 = 5K + 2K',\ m_0 = 5m$$

$$f_5 = C\sqrt{\frac{5K + 2K'}{5m}}$$

where $f_5$ denotes the minimal resonance frequency of the loudspeaker apparatus 10A.

The ratio of f5 to f1 is expressed by the following expression:

$$\frac{f_5}{f_1} = \sqrt{\frac{5k + 2}{5(k + 2)}}$$

where k=K/K'.

For example, when $f_1$=100 Hz and k=1.27, $f_5$=71.5 Hz. The minimal resonance frequency is significantly reduced.

In the case that the number of the speaker units is generalized to be denoted as n, the expression becomes:

$$\frac{f_n}{f_1} = \sqrt{\frac{nk + 2}{n(k + 2)}}$$

where fn denotes the minimal resonance frequency of the loudspeaker apparatus having the n speaker units.

In this manner, the space inside the body is divided into a number of small sealed spaces, and the diaphragms are provided at boundaries between the sealed spaces. The diaphragms facilitate movement of air inside the spaces, and thereby the minimal resonance frequency of the loudspeaker apparatus is significantly reduced.

The sealed space is preferable to be small in volume. This reduces an amount of the air moved by the boundary diaphragms, and thereby the air resistance becomes smaller. For example, the sealed space may be formed along the outline of the speaker unit, as in the loudspeaker apparatuses 10B and 10G.

The two boundary diaphragms driven toward the opposite directions are preferable to be close in distance. This reduces the time for transmission of air vibration, or sonic wave, created on one of the boundary diaphragms to the other one of the boundary diaphragms, to be neglectable, and thereby the air resistance is also reduced further. For example, the speaker units may be arranged to make the nearest proximity between the boundary diaphragms. The boundary diaphragms may be arrange in the lateral direction, as in the loudspeaker apparatus 10A, in the axial direction, as in the loudspeaker apparatus 10P, or in other any directions.

In the sealed space, the boundary diaphragms may be arranged so that the surfaces facing outside the sealed space are oriented to substantially the same direction. The reaction force created by the movement of the diaphragm acts toward a direction perpendicular to the diaphragm. Driving the two boundary diaphragms toward the opposite directions makes the reaction forces in the opposite directions. Thereby, the two reaction forces created in the two driver units are partially cancelled with one another. The reduced influence of the reaction forces enables improved sound reproducibility.

For example, in the loudspeaker apparatus 10A, the resultant force of the reaction forces created in the five driver units 13*a* to 13*e* is equal to the reaction force created in the driver unit 13*c*. The reaction forces created in the other four driver units are cancelled.

In the sealed space, the boundary diaphragms may be arranged on substantially the same planes. Examples for it include the loudspeaker apparatuses 10A, 10B, 10E, 10F, 10G and 10J.

At least two of the speaker units may be exposed speaker units. The diaphragms of the exposed speaker unit vibrates outside air to create sound to be heard by a user of the loudspeaker apparatus. When the diaphragms are driven to maintain all of the sealed spaces to have constant volumes, the sound created outward by the two exposed speaker units have opposite phases to one another. Thus, it is required to prevent cancellation of the two sounds with one another.

For this reason, it is preferable that two of the exposed speaker units are disposed the farthest from one another. For example, in the loudspeaker apparatus 10A, the distance between the two exposed speaker units 13*a* and 13*e* is the largest one of the distances between two any speaker units. In the case of the loudspeaker apparatus 10A, the speaker units 13*a* to 13*e* are arranged so that all of the diaphragms 31*a* to 31*e* are located on substantially the same lines, the sealed spaces 22*a* to 22*d* are formed by connecting between the front or rear side spaces of two adjacent speaker units. This enables both of the small distances between the diaphragms of the adjacent speaker units and the large distance between the two exposed speaker units.

Figure 2:
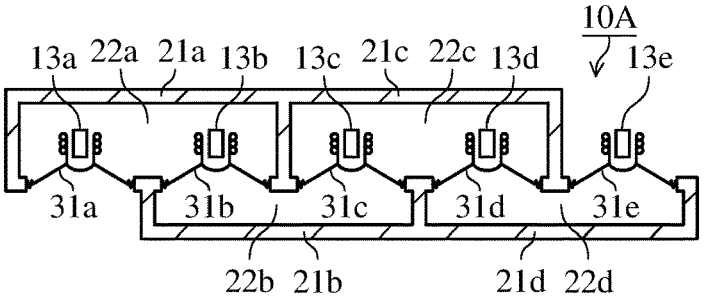
FIG. 2 is an end view taken along II-II in FIG. 1.
Figure 3:
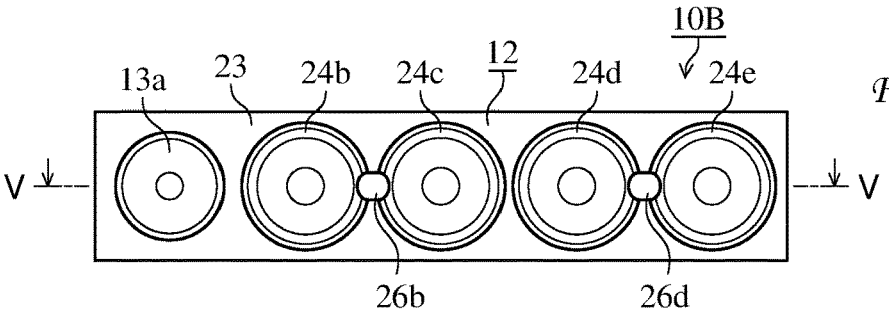
FIG. 3 is a front view illustrating another examplary loudspeaker apparatus 10B.
Figure 4:
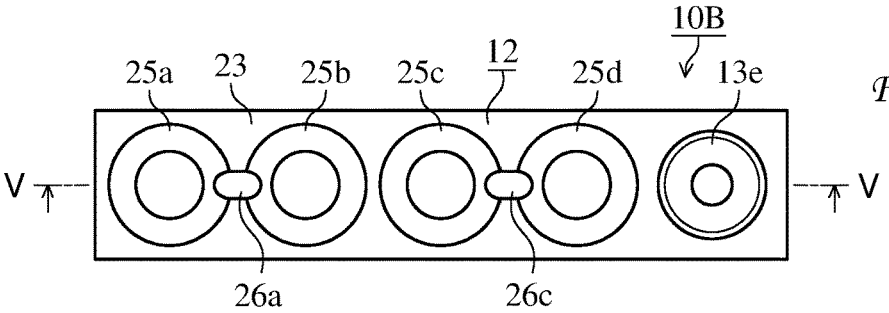
FIG. 4 is a back view illustrating the loudspeaker apparatus 10B.
Figure 5:
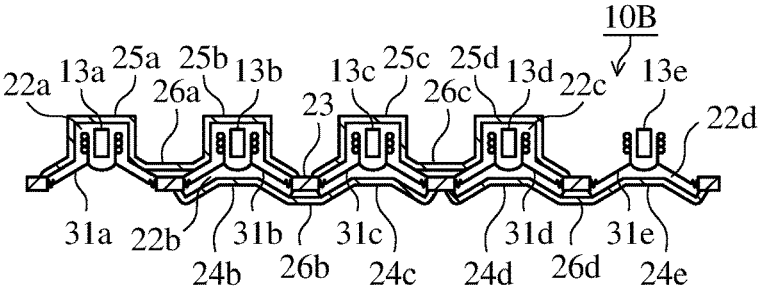
FIG. 5 is an end view taken along V-V in FIG. 3.
Figure 6:
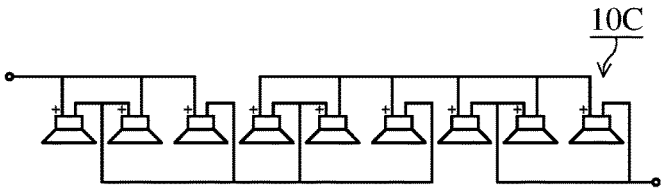
FIG. 6 is a circuit diagram illustrating an electrical circuit configuration of another examplary loudspeaker apparatus 10C.
Figure 7:
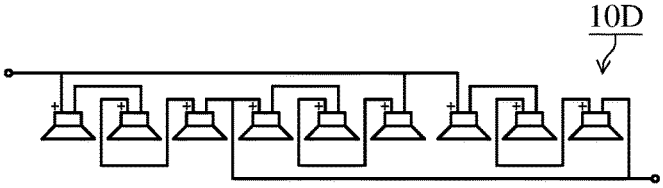
FIG. 7 is a circuit diagram illustrating an electrical circuit configuration of another examplary loudspeaker apparatus 10D.
Figure 8:
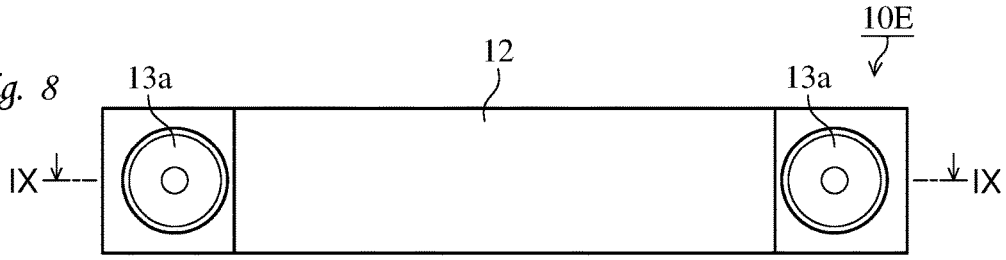
FIG. 8 is a front view illustrating another examplary loudspeaker apparatus 10E.
Figure 9:
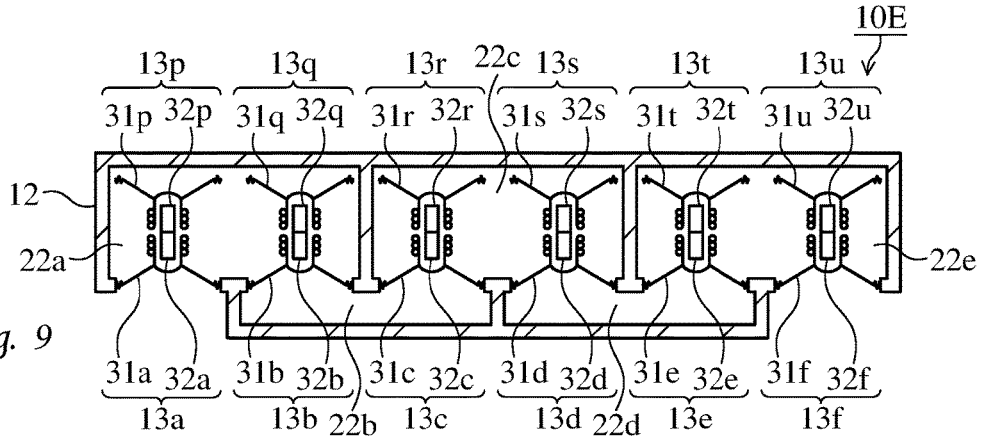
FIG. 9 is an end view taken along IX-IX in FIG. 8.
Figure 10:
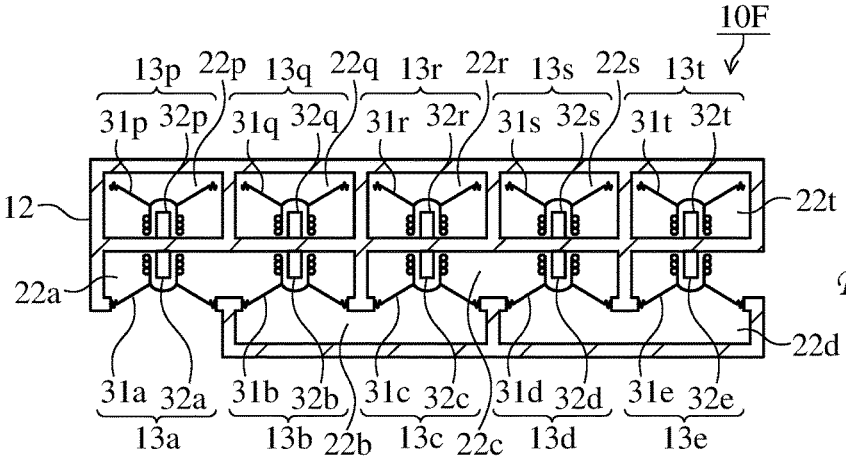
FIG. 10 is an end view illustrating another examplary loudspeaker apparatus 10F.

It is also preferable that two of the exposed speaker units are disposed so that the exposed surfaces of the diaphragms are oriented to substantially opposite directions. In the loudspeaker apparatus 10A, the diaphragm 31*a* of the exposed speaker unit 13*a* has the surface exposed outside and oriented downward in FIG. 2, while the diaphragm 31*e* of the exposed speaker unit 13*e* has the surface exposed outside and oriented upward in FIG. 2. In the case of the loudspeaker apparatus 10A, this is realized by the odd number of the speaker units 13*a* to 13*e*. That is, the number of the speaker units is not limited to five, and may be three, seven, or other odd numbers.

The loudspeaker apparatus 10J has the four exposed speaker units 13*a*, 13*e*, 13*p* and 13*t*. Two of the exposed speaker units 13*a* and 13*p* are adjacently arranged to one another, and create sounds with the same phases as one another. The other two of the exposed speaker units 13*e* and 13*t* are also disposed near by one another, and generate sounds having the same phases as one another. And the two sets of the adjacent exposed speaker units are placed at the farthest position from one another, and produce sounds with the opposite phases to one another.

The loudspeaker apparatus 10L has the three exposed speaker units 13*a*, 13*e* and 13*t*. Two of the exposed speaker units 13*e* and 13*t* are adjacently arrange to one another. The other one of the exposed speaker units 13*a* is disposed apart from the two exposed speaker units 13*e* and 13*t*. The diaphragm of the exposed speaker unit 13*t* is entirely exposed outside. This causes cancellation of sounds created on the front and rear sides of the surface with one another. For this reason, the user is preferable to listen the sound at a side, especially in front, of the exposed speaker unit 13*a*.

Two of the speaker units may be disposed so that the driver units are located back to back. For example, in the loudspeaker apparatus 10E, the speaker units 13*a* and 13*p* are disposed to be oriented to the opposite directions so that the rear ends of the driver units 32*a* and 32*p* comes into contact with one another. In the loudspeaker apparatus 10F, the speaker units 13*a* and 13*p* are arranged in the reversed directions so that the rear ends of the driver units 32*a* and 32*p* directly face one another across a board, which is part of the body 12.

The paired speaker units are wired so that the driver units input the electrical signals with the same phases. Since the driver units are arranged back to back, the reaction forces created in the driver units are completely cancelled with one another.

In the loudspeaker apparatuses 10E to 10N, all of the speaker units form pairs. Thus, all of the reaction forces are completely cancelled. This eliminates need for consideration about influence of the reaction forces, and thereby improves flexibility of arrangement of the speaker units. Thus, the sealed space can be further reduced.

In the loudspeaker apparatus 10E, the speaker units 13*p* to 13*u* are provided only for cancellation of reaction forces, and disposed within the same sealed spaces as the counterpart speaker units.

In the loudspeaker apparatus 10F, the speaker units 13*p* to 13*u* for cancellation of reaction forces are disposed within the small sealed spaces 22*p* to 22*t*, each of which accommodates only one speaker unit. This enables to reduce the volumes of the sealed spaces 22*a* to 22*d*, which distribute to create sound.

In the loudspeaker apparatus 10G the speaker units 13*p* to 13*u* for cancellation are housed within the one big sealed space 22*p*.

In the loudspeaker apparatus 10J, all of the paired speaker units distribute sound generation. One sound is generated by distribution of a series of the speaker units 13*a* to 13*e* and the sealed spaces 22*a* to 22*d*. Another series of the speaker units 13*p* to 13*t* and the sealed spaces 22*p* to 22*s* distribute to generate another sound.

Also in the loudspeaker apparatus 10N, all of the paired speaker units distribute sound creation. All of the speaker units 13*a* to 13*s* and the sealed spaces 22*a* to 22*t* form one series to create one sound.

The speaker units may be wired so that the induced electromotive forces created in the driver units are cancelled with one another. This reduces the total sum of the induced electromotive forces in the loudspeaker apparatus, and thereby improves sound reproducibility.

The above described embodiments are examples to make it easier to understand the present invention. The present invention is not limited to the examples, and includes any modified, altered, added, or removed variations, without departing from the scope of the claims attached herewith. This can be easily understood by persons skilled in the art.

REFERENCE SIGNS LIST

10A to 10P: loudspeaker apparatus; 12: body; 13*a* to 13*u*: speaker unit; 21*a* to 21*d*: box; 22*a* to 22*t*: sealed spaces; 23: board; 24*b* to 24*e* and 25*a* to 25*d*: cover; 26*a* to 26*d*: pipe; 31*a* to 31*u*: diaphragm; and, 32*a* to 32*u*: driver unit.

The invention claimed is:

1. A loudspeaker apparatus, comprising:
at least three speaker units; and
a space defining part defining at least two sealed spaces, wherein
each of the speaker units has a diaphragm having two surfaces, and a driver unit for inputting an electrical signal and driving the diaphragm,
each driver unit inputs substantially the same electrical signal with substantially the same or opposite phases,
each of at least two of the sealed spaces has at least two boundary diaphragms,
each of the boundary diaphragms is one of the diaphragms, disposed so that a first one of the surfaces faces inside a sealed space and a second one of the surfaces faces outside the sealed space,
when at least one of the boundary diaphragms is driven outward from the sealed space, at least one of the other boundary diaphragms is driven inward to the sealed space, the boundary diaphragms driven outward and the boundary diaphragms driven inward are the same in number, and thereby a volume of the sealed space is kept constant, and
at least one of the boundary diaphragms is disposed at a boundary between two of the sealed spaces having volumes kept constant, one of its surfaces faces inside one of the two sealed spaces and a second one of its surfaces faces inside the other of the two sealed spaces.

2. The loudspeaker apparatus of claim 1, wherein at least one of the sealed spaces has at least two of the boundary diaphragms arranged so that the surfaces facing outside the sealed space are oriented to substantially the same directions.

3. The loudspeaker apparatus of claim 1, wherein at least one of the sealed spaces has at least two of the boundary diaphragms arranged on substantially the same planes.

4. The loudspeaker apparatus of claim 1, wherein
at least two of the speaker units are exposed speaker units,
in each of the exposed speaker units, at least one of the surfaces of the diaphragm is exposed outside.

5. The loudspeaker apparatus of claim 4, wherein
no distance between any two of the speaker units is larger than a distance between two of the exposed speaker units.

6. The loudspeaker apparatus of claim 4, wherein
two of the exposed speaker units are disposed so that the exposed surfaces of the diaphragms are oriented to substantially opposite directions.

7. The loudspeaker apparatus of claim 1, wherein
at least one of the speaker units is a sealed speaker unit,
in the sealed speaker unit, the two surfaces of the diaphragm face inside the same or different sealed spaces.

8. The loudspeaker apparatus of claim 1, wherein
all of the diaphragms are arranged on substantially the same lines.

9. The loudspeaker apparatus of claim 1, wherein
a number of the speaker units is an odd number.

10. The loudspeaker apparatus of claim 1, wherein
a number of the speaker units is a product of two natural numbers larger than 1.

11. The loudspeaker apparatus of claim 1, wherein
at least two of the speaker units forms at least one pair,
each of the pair includes two of the speaker units,
in each of the pair, the driver units are disposed back to back, and input the electrical signals with substantially the same phases, and thereby reaction forces created by movement of the two diaphragms are cancelled.

* * * * *